United States Patent [19]

Meissner

[11] Patent Number: 4,838,140

[45] Date of Patent: Jun. 13, 1989

[54] VIOLIN

[76] Inventor: Henry Meissner, 4585 El Caro La., Carpinteria, Calif. 93013

[21] Appl. No.: 137,880

[22] Filed: Dec. 24, 1987

[51] Int. Cl.[4] ..... G10D 1/02
[52] U.S. Cl. ..... 84/275
[58] Field of Search ..... 84/274, 275

[56] References Cited

U.S. PATENT DOCUMENTS

| | | | |
|---|---|---|---|
| 980,938 | 1/1911 | Gasche | 84/275 |
| 1,173,017 | 2/1916 | Morris | 84/275 |
| 3,969,971 | 7/1976 | Delu | 84/274 |

FOREIGN PATENT DOCUMENTS

| | | | |
|---|---|---|---|
| 148443 | 2/1904 | Fed. Rep. of Germany | 84/275 |
| 99950 | 12/1961 | Netherlands | 84/274 |

*Primary Examiner*—Lawrence R. Franklin
*Attorney, Agent, or Firm*—Amster, Rothstein and Ebenstein

[57] ABSTRACT

A three-quarter size violin comprises a body assembly wherein the length of the body assembly is approximately $13\frac{1}{4}''$, the width of an upper bout of the body assembly is approximately $6\frac{1}{2}''$ to $6\frac{5}{8}''$, the width of a center bout of the body assembly is approximately $4\frac{1}{2}''$ to $4\frac{3}{8}''$, the width of the lower bout of the body assembly is approximately $8\frac{1}{8}''$, and the height of generally continuous ribwood tapers along the length of the upper rib section.

16 Claims, 2 Drawing Sheets

VIOLIN

BACKGROUND OF THE INVENTION

The present invention relates to violins and more particularly to three quarter size violins.

A full-size violin is too large for an average child to manipulate and, hence, to play properly. Typically, the mensur, or string length, is too long and the child's hand cannot reach the fingerboard. Heretofore to overcome this problem, three-quarter size violins have been manufactured which provide a mensur sufficient for a child to handle. However, the volume of air in these violins is less than that of a full size violin which results in an air-space tone sound of $E_b$ above Middle C, which is higher pitched than the air space tone of a full size violin which sounds C above Middle C. As a result, these prior art three-quarter size violins do not produce sound as full or powerful as that of a full size violin, and are generally viewed as inferior in overall tone quality. Further, because of the inferior sound of these three-quarter size violins, a child's ability to perform as a concert violinist is impeded.

Accordingly, it is an object of the present invention to provide a three-quarter size violin which provides a sound or tone quality equivalent to that of a full size violin.

Another object is to provide such a three-quarter size violin that contains a volume of air substantially similar to that of a full size violin.

A further object is to provide such a three-quarter size violin that possesses an air space tone sound of C above Middle C.

It is also an object to provide such a three-quarter size violin that produces sound as full and powerful as a full-size violin.

It is another object to provide such a three-quarter size violin that will not impede a childs ability to perform as a concert violinist.

Still another object is to provide such a three-quarter size violin that provides a vital combination of excellent tonal quality and aesthetic beauty.

It is still another object to provide a three-quarter size violin which is of quality construction.

SUMMARY OF THE INVENTION

In accomplishing these and other objects in accordance with the preferred embodiment, the three-quarter size violin of the present invention comprises a body assembly, and a neck affixed to the body assembly at one end. The body assembly includes a top plate having a pair of f-holes formed therein, a back plate, and a generally continuous ribwood therebetween fixed proximate to and generally conforming to the periphery of the plates. The ribwood includes an upper rib section, a center rib section and a lower rib section. The upper rib section defines an upper bout section of the body assembly, the center section defines a center bout section of the body assembly, and the lower rib section defines a lower bout section of the body assembly. The overall length of the violin is approximately $21\frac{3}{4}''$, the length of the body assembly is approximately $13\frac{1}{4}''$, the width of the upper bout is approximately $6\frac{1}{2}''$ to $6\frac{5}{8}''$, the width of the center bout is approximately $4\frac{1}{2}''$ to $4\frac{3}{8}''$, and the width of the lower bout is approximately $8\frac{1}{8}''$. The height of the ribwood tapers along the length of the upper rib section.

In a preferred embodiment, the height of the upper rib section tapers from approximately $1\frac{1}{4}''$ to approximately $1\frac{1}{8}41$ , and the volume of air of the violin is substantially equal to the volume of air of a full-size violin so that the air-space tone sounds C above Middle C.

Preferably, the length of the f-holes are substantially similar to the lengths of f-holes in full-size violins, namely, approximately 3" in length; and the narrowest distance between the f-holes is approximately $1\frac{5}{8}''$. It is also preferable that the violin includes a bridge, having bridge feet, which is substantially similar in size to a bridge used in a full-size violin, with the bridge feet having spacing identical to the narrowest distance between the f-holes.

Preferably, a bass-bar similar in size to a bass-bar used in a full-size violin is used, measuring $10\frac{1}{4}''$ in length.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing, wherein similar reference characters denote similar elements throughout the several figures.

DETAILED DESCRIPTION OF THE PREFERRED EMBODIMENT

Figure 1:
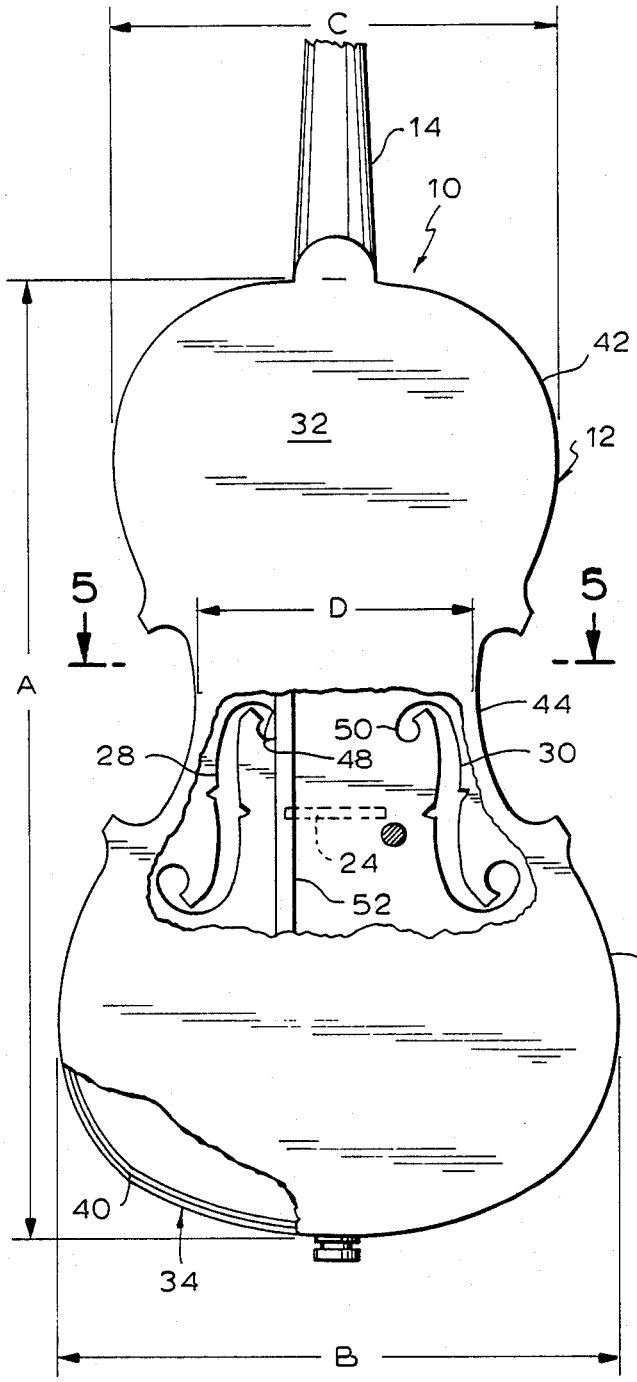
FIG. 1 is a fragmentary bottom plan view, partially broken away, of a three-quarter size violin according to the present invention.
Figure 2:
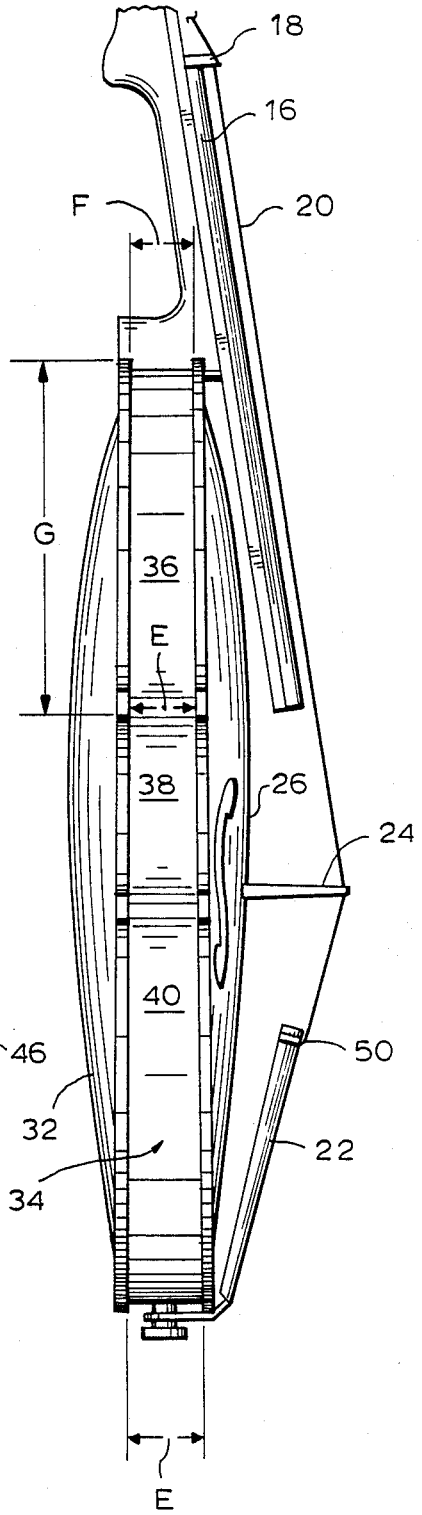
FIG. 2 is a fragmentary side elevation view thereof.
Figure 3:
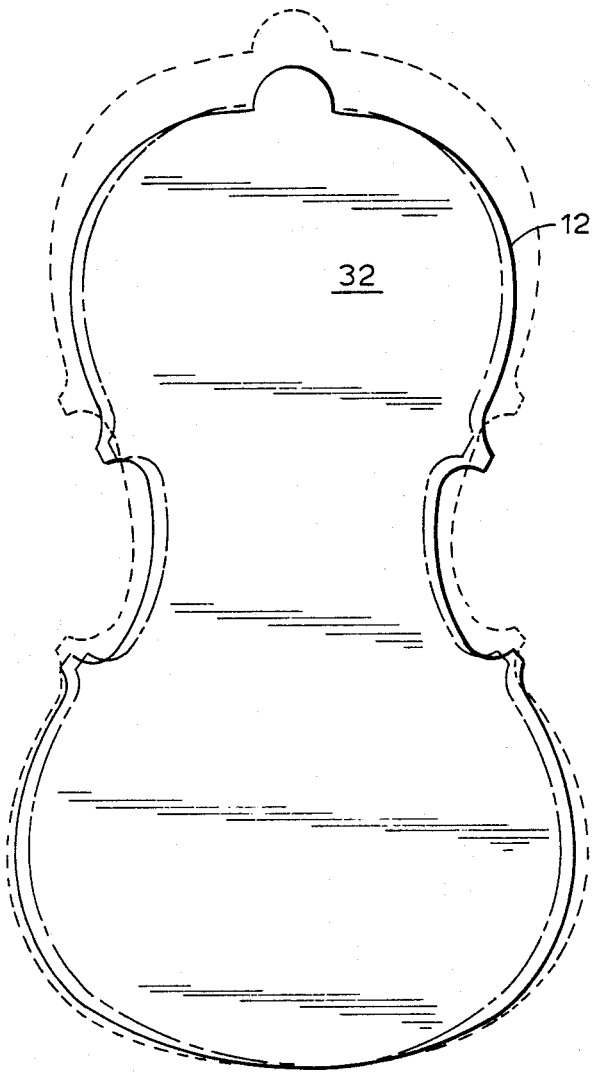
FIG. 3 is a top plan view of the body size of the violin of the present invention with the body size of a full-size violin in dash line and the body size of a prior art three-quarter size violin in phantom line, superimposed therein.

Referring now to the drawings, and in particular to FIGS. 1–3, therein illustrated is a three-quarter size violin of the present invention generally designated by the reference numeral 10. The violin 10 in its conventional aspects includes a body assembly, generally designated by the reference numeral 12, and a neck 14 fixed to one end of the body assembly 12. At the opposite end of the neck 14 is a scroll portion (not shown) having conventional pegs. A fingerboard 16 is fixed to a surface of the neck 14. Also fixed to the surface of the neck 14 is a nut 18 which is used to align a set of strings 20 which extend from the scroll portion to a tail piece 22. The fingerboard 20 extends from the nut 18 until it hangs over a portion of the body assembly 12 in the manner shown in FIG. 2. It will be readily appreciated by those skilled in the art that one end of the strings 20 is secured by the pegs of the scroll portion, and the other end by the tail piece 22. A bridge 24 is positioned between the fingerboard 16 and the tailpiece 22. It will also be appreciated by those skilled in the art that a chin rest (not shown) is secured to the body proximate the tailpiece 22, and that a bow (not shown) may be used to engage the strings 20 in order to play the violin 10

The body assembly 12 includes a top plate 26, having a pair of f-holes 28 and 30 formed therein, and a back plate 32. Sandwiched between the top plate 26 and the back plate 32 is a generally continuous wall or ribwood, generally designated by reference numeral 34, conforming to the periphery or the outline of the plates 26 and 32. The ribwood 34 is recessed approximately one-eighth of an inch from the periphery of the plates 26 and 32 which causes the plates to overhang the ribwood 34 by that amount. The ribwood 34 is essentially symetrical about an axis defined by the neck 14, and is fixed to the plates 26 and 32 by the use of glue or any other method presently known by those skilled in the art.

The ribwood 34 consists of an upper rib section 36 which includes a pair of upper ribs, a center rib section 38 which includes a pair of center ribs, and a lower rib section 40 which includes a pair of lower ribs. The ribs are bent to conform to the periphery of the plates 26 and 32 by an of the known methods.

The upper rib section 36, the center rib section 38 and the lower rib section 40 define three sections of the body assembly 12. The upper rib section defines an upper bout section 42, the center rib section defines a center bout section 44 and the lower rib section defines a lower bout section 46.

Referring now to FIG. dimension A defines the length of the body assembly 12, dimension B defines the width of the lower bout section 46, dimension C defines the width of the upper bout section 42 and dimension D defines the width of the center bout section 4 of the body assembly 12. Dimension A measures 13¼ inches, dimension B measures 8⅛ inches, dimension C measures 6½ inches and dimension D measures 4⅜ inches. It has been found that dimension C can be varied between 6½ and 6⅝ inches and dimension D can be varied between 4⅜ and 4½ inches without a degradation in tonal quality.

The dimensions of the body assembly 12 have been found to provide a volume of air substantially similar to that of a full-size violin. As a result, the air-space tone of the violin 10 sounds C above Middle C which is equal to the air-space tone sound of a full-size violin. This enables the violin 10 to sound as full or powerful as a full-size violin. In contrast, the volume of air in a standard three-quarter size violin is less than that of a full-size violin which results in a higher pitched air-space tone sound of $E_b$ above Middle C. It is for this reason that these prior art three-quarter size violins are viewed as being inferior in overall tone quality.

Referring now to FIG. 3, the body assembly of the hybrid violin 10 is shown to be broader than the body assembly of a typical prior art three-quarter size violin, yet identical in overall length. Also, the hybrid violin 10 is not as long or as broad as a full-size violin. The body lengths (and the string lengths) of the violin 10 and the prior art three-quarter size violins must be essentially the same to accommodate the relative arm size and grip size of children.

It has also been found that a taper in the rib-heights of the ribwood 34 from a height greater than that found in full-size violins to a height similar to standard three-quarter size violins significantly contributes to the increased sound quality of the hybrid violin 10. Referring now to FIG. 2, dimension E defines the height of lower rib 40, the height of the center rib 38, and the height of a lower portion of the upper rib 36 and an upper portion of the center rib 38. Dimension F defines the height of an upper portion of the upper rib 36, and dimension G defines the distance from the top of the body assembly 12 to the juncture point of the lower portion of the upper rib 36 and the upper portion of the center rib 38. Dimension G measures 4⅞", and the height of the ribwood 34 remains a constant 1¼" (dimension E) from the beginning of the lower rib 40 to the juncture point of the upper portion of the center rib 38 and the upper rib 36. The height of the ribwood 34 then uniformly tapers ⅛" along the length of the upper rib 36 from the juncture point, having a rib-height of 1¼" (dimension E), to the top of the upper rib 36, having a rib-height of 1⅛" (dimension F).

In a full-size violin, the height of the ribwood uniformly tapers along the entire length of the violin, typically from 1 3/16" to 1⅛". In prior art three-quarter size violins, the rib-heights are uniform and do not vary or taper along either the entire length, or along a partial length, of the ribwood.

Figure 4:
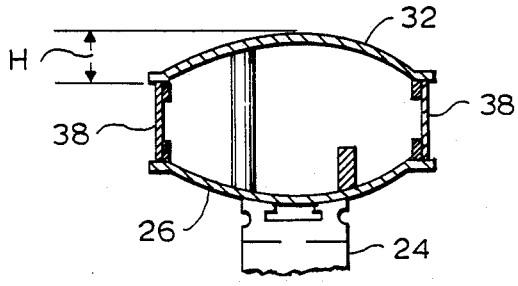
FIG. 4 is a cross-sectional view of the violin of the present invention taken along line 5—5 of FIG. 1.

Also contributing to the increased sound quality of the hybrid violin 10 is the plate depth of the top plate 26 and the back plate 32. Referring now to FIG. 4, dimension H defines the plate depth of back plate 32 which is identical to the plate depth of top plate 26 (not shown). Dimension H measures ½". In prior art three-quarter size violins, the plate depth is well below one half inch, measuring approximately ⅜". In full-size violins, the plate depth measures ½", and have been known to be less.

It has also been found that the size and positioning of the f-holes 28 and 30, the size and position of the bridge 24, and the size of the bass-bar 52, all contribute to the increased sound quality of the violin 10.

Referring now to FIG. the f-holes 28 and 30 are equal in length to f-holes found in full-size violins, which measure 3". Also, the distance between the points 48 and 50 of f-holes 28 and 30 is to be 1⅝", which is equal to the distance between similar points of f-holes found in full-size violins. If the f-holes are too close to each other, this will detract from the "woody brilliance" of the violin, lower its pitch, and weaken the "highs" needed for good, bright violin tone.

The bridge 24 is to be identical to bridges used in full-size violins, and the bridge feet of the bridge 24 (not shown) are spaced identical to the spacing between points 48 and 50 of the f-holes 28 and 30. The use of a full-size bridge results in a greater string distance (than a comparable distance of a prior art three-quarter size violin) between the nut 18, and a point 50 where the strings 20 are fastened to the tailpiece 22. As compared to prior art three-quarter size violins, this increase in string distance, in combination with the increased plate depth explained previously, increases the tension of the strings, thereby contributing to an increase in tonal power. Further, the use of a full-size bridge increases the spacing of the strings 20 which also contributes to the increased tone quality of the violin. If a smaller bridge is used, i.e. a bridge that is narrower and lower, the tone of the violin will be weakened due to a resultant decrease in string tension.

A bass-bar 52, fixed to the underside of the top plate 26, measures 10¼" in length. This compares to a bass-bar measuring 10½" in a full-size violins.

Table I sets forth dimensions of four prior art three-quarter size violins along with analogous measurements of the preferred embodiment of the present invention. As can be seen from this table, the violin of the preferred embodiment is essentially equal to the prior art three-quarter size violins in overall length, body length and string length. As stated previously, these parameters must be similar to assure that the violin can accommodate the arm size and the fingering of children. The upper bout, center bout and lower bouts of the present invention are broader than the prior art three-quarter size violins, and the rib-height tapers to a height greater than the uniform rib-heights of these violins.

To summarize, the violin of the present invention provides a three-quarter size violin that produces a sound or tone quality as full and powerful as a full-size violin. The violin contains a volume of air substantially similar to a full-size violin and possesses a resultant air-space tone sound of C above C. The violin provides a vital combination of excellent tone quality and aesthetic beauty, and is of quality construction.

Now that the preferred embodiments have been shown and described in detail, various modifications and improvements thereon will become readily apparent to those skilled in the art. Accordingly, the appended claims are to be construed broadly and in a manner consistent with the spirit and scope of the present invention.

TABLE I (in inches)

| | Overall Length | Body Length | Upper Bout Width | Center Bout Width | Lower Bout Width | Rib Height | f-Holes Length | Narrowest Distance between f-Holes | Mensur or String Length From Nut To Bridge |
|---|---|---|---|---|---|---|---|---|---|
| Becker-German ¾violin | 22 | 13¼ | 6⅛ | 4 | 7½ | 1 3/16 | 2¾ | 1⅜ | 11⅞–12 |
| Old German ¾violin | 21¾ | 13¼ | 6 | 4 | 7½ | 1 3/16 | 2¾ | 1 5/16 | 11⅞–12 |
| European ¾violin | 22 | 13¼ | 6⅛ | 4 | 7⅝ | 1⅛ | 2¾ | 1⅜ | 11⅞–12 |
| Suzuki-Japanese ¾violin | 21½ | 13⅛ | 6¼ | 4¼ | 7¾ | 1⅛ | 2¾ | 1⅝ | 11⅞ |
| Hybrid violin of present invention | 21¾ | 13¼ | 6½ | 4⅜ | 8⅛ | 1¼–1⅛ (taper) | 3 | 1⅝ | 11⅞ |

What I claim is:

1. A three-quarter sized violin comprising: a body assembly, and a neck affixed to the body assembly at one end, said body assembly including a top plate having a pair of f-holes formed therein, a back plate, and a generally continuous ribwood, therebetween, fixed proximate to and generally conforming to the periphery of said plates, said ribwood including an upper rib section, a center rib section, and a lower rib section, said upper rib section defining an upper bout section of said body assembly, said center rib section defining a center bout section of said body assembly, and said lower rib section defining a lower bout section of said body assembly, wherein the volume of air of said violin is approximately equal to the volume of air of a full-size violin, and the length of said body assembly is approximately equal to the length of the body assembly of a three-quarter size violin.

2. The violin of claim 1 wherein the height of said upper rib section uniformly tapers from approximately 1¼" to approximately 1⅛" along the entire length of the upper rib section.

3. The violin of claim 1 wherein the width of the upper bout is approximately 6½" to 6⅝", the width of the center bout is approximately 4½" to 4⅜", and the width of the lower bout is approximately 8 ⅛".

4. The violin of claim 1 wherein the air-space tone sounds C above Middle C.

5. The violin of claim 1 wherein the length of said f-holes is substantially similar to the lengths of f-holes in a full-size violin.

6. The violin of claim 5 wherein the length of said f-holes is approximately 3".

7. The violin of claim 6 wherein the narrowest distance between the f-holes is approximately 1⅝".

8. The violin of claim 7 comprising a bridge, including bridge feet, which is substantially similar in size to a bridge used in a full-size violin.

9. The violin of claim 8 wherein said bridge feet have spacing identical to said narrowest distance between said f-holes.

10. The violin of claim comprising a bass-bar similar in size to a bass bar used in a full-size violin.

11. The violin of claim 10 wherein said bass-bar measures 10¼" in length.

12. The violin of claim 1 wherein the overall length of said violin is approximately 21¾".

13. The violin of claim 1 wherein the height of said ribwood tapers along the entire length of the upper rib section.

14. The violin of claim 1 wherein the length of said body assembly is approximately 13¼".

15. A three-quarter size violin comprising:

a body assembly, and a neck affixed to the body assembly at one end, said body assembly including a top plate having a pair of f-holes formed therein, a back plate, and a generally continuous ribwood, therebetween, fixed proximate to and generally conforming to the periphery of said plates, said ribwood including an upper rib section, a center rib section and a lower rib section, said upper rib section defining an upper bout section of said body assembly, said center section defining a center bout section of said body assembly and said lower rib defining a lower bout section of said body assembly, wherein the length of said body assembly is approximately 13¼", the width of the upper bout is approximately 6½" to 6⅝", the width of the center bout is approximately 4½" to 4⅜", the width of the lower bout is approximately 8⅛", and the height of said ribwood tapers along the length of said upper rib section from approximately 1¼" to approximately 1⅛" so that the volume of air of the body assembly is substantially equal to the volume of air of a full-size violin to emit an air-space tone sound of C above Middle C.

16. The violin of claim 15, wherein, the overall length of said violin is approximately 21¾".

* * * * *